US005623722A

United States Patent [19]

Hawley et al.

[11] Patent Number: 5,623,722

[45] Date of Patent: Apr. 22, 1997

[54] DOCUMENT SET COMPILER AND EJECT SYSTEM

[75] Inventors: Rodney L. Hawley, Webster; David F. Johnson, Victor; Edward T. Bloomer, Rochester, all of N.Y.

[73] Assignee: Xerox Corporation, Stamford, Conn.

[21] Appl. No.: 458,043

[22] Filed: Jun. 1, 1995

[51] Int. Cl.[6] ..... G03G 15/00

[52] U.S. Cl. ..... 399/397; 270/58.01

[58] Field of Search ..... 355/308, 321, 355/317; 271/3.1, 3.14; 399/397; 270/58.01

[56] References Cited

U.S. PATENT DOCUMENTS

| | | | |
|---|---|---|---|
| 4,541,626 | 9/1985 | Millen | 271/236 |
| 4,826,383 | 5/1989 | Millen | 414/789.9 |
| 4,989,854 | 2/1991 | McNamara | 271/3.1 |
| 5,048,812 | 9/1991 | Holmes | 271/11 |
| 5,050,859 | 9/1991 | Paxon | 271/270 |
| 5,088,590 | 2/1992 | Marschke | 198/461 |
| 5,166,735 | 11/1992 | Malachowski | 355/282 |
| 5,260,757 | 11/1993 | Frank et al. | 355/317 |

*Primary Examiner*—William J. Royer
*Attorney, Agent, or Firm*—Denis A. Robitaille

[57] ABSTRACT

A document set compiler and eject apparatus including a belt transport system as well as an output roll system, wherein the belt and rolls of each respective system operate in conjunction with one another to provide smooth and effective transport of the document set from a compiler tray to an output tray. In particular, the output rolls, located downstream from the belt, are driven at a speed substantially greater than the speed of the transport belts for actively removing the document set from the belts to prevent damage to the trail edge thereof. The compiler tray also includes a retard roll system for maintaining the registration of the document set as it is transferred from the transport belts to the output rolls.

16 Claims, 2 Drawing Sheets

DOCUMENT SET COMPILER AND EJECT SYSTEM

Figure 1:
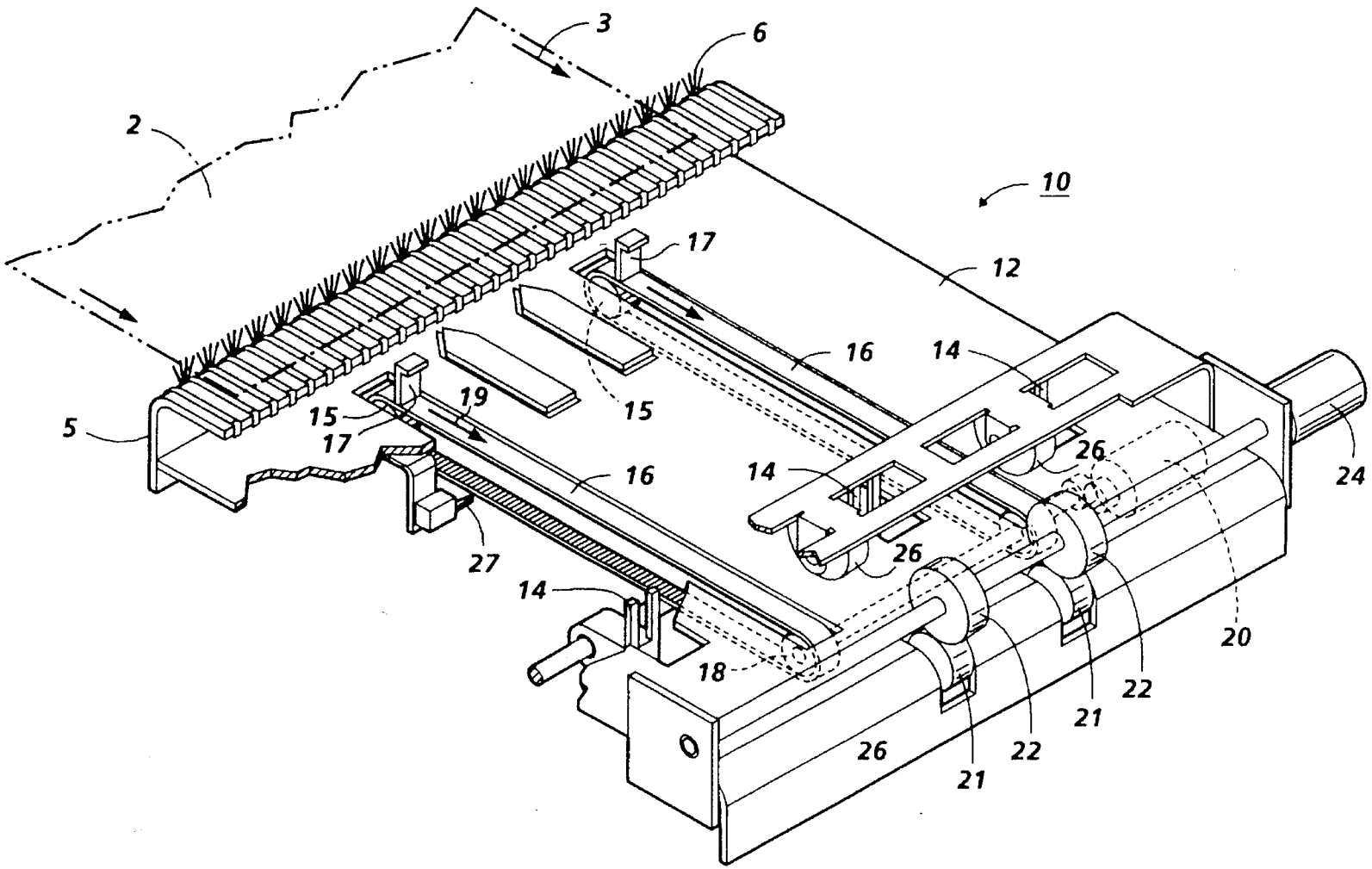

The present invention relates to a high speed printing system and, more particularly, concerns a compiler tray for use in a high speed printing machine including a document set transport system for delivering document sets to an output tray.

In a typical high speed electrostatographic printing machine, output copy sheets are accumulated into a stack in a compiler tray for creating a document set which can be delivered to an output tray. The output copy sheets are accumulated and aligned in registration with one another in the compiler tray, situated atop a pair of stationary conveyor belts which may be periodically driven through a transport cycle. Thus, when a sufficient number of output copy sheets have been collected, as may be indicated by an output count equaling a predetermined number, a motor is activated for setting the conveyor belts into transport motion to deliver the document set to the output tray.

A compiler tray is typically utilized for stacking sheets fed serially thereto in registration with each other so as to provide an neat and uniform document set having uniformly aligned edges. The sheets may be registered against a single registration edge or dual registration edges for providing both lateral and longitudinal alignment with respect to the direction of travel of the sheets. It is also desirable to transport or eject a compiled document set from the compiler tray without stapling or otherwise binding the document set. Rapid ejection of the document set is desirable to avoid interrupting the delivery of sheets to the compiler tray. In addition, it is important that no disturbance to the document set occurs during the document set ejection process which may cause misalignment of the previously registered document set.

The present invention is particularly concerned with a sheet compiler and document set eject system in which a stack of sheets is compiled into a document set which is transported from the compiler tray into an output tray or storage location for subsequent processing or removal by an operator.

Various approaches to sheet compilation and document set transport have been proposed and utilized in the art. The following disclosures may be relevant to various aspects of the present invention:

U.S. Pat. No. 4,541,626

Patentee: Millen

Issued: Sep. 17, 1985

U.S. Pat. No. 4,826,383

Patentee: Millen

Issued: May 2, 1989

U.S. Pat. No. 4,989,854

Patentee: McNamara

Issued: Feb. 5, 1991

The relevant portions of the foregoing disclosures may be briefly summarized as follows:

U.S. Pat. No. 4,541,626 discloses a sheet registration apparatus and device for registering a sheet on a surface against the registration stop including a wiper device having a plurality of resilient blades rotatable about an axis which is generally normal to the support surface. The blades extend toward sheet engaging tips Which are arranged to wipe across the sheet surface over a limited arc of rotation so as to urge the sheets toward the registration stop. To this end, the blades are held out of contact with the sheets during part of each revolution by a swash plate having an arcuate opening.

U.S. Pat. No. 4,826,383 discloses a sheet mechanism having drive means for removing compiled sheet sets therefrom, wherein sheets are compiled in a tray against a registration edge and a completed set is ejected with the registration members being retracted by an eject mechanism comprising a continuously rotating drive roller projecting through a base of a tray and a coacting idler roller mounted on a spring arm which is retracted during stacking and then pressed against the top of the completed set to effect ejection. Preferably, the drive roller is a deformable roller having a low coefficient of friction surface.

U.S. Pat. No. 4,989,854 discloses a document set delivery apparatus wherein a set of copy sheets deposited on a surface is delivered positively to an output by engaging the trail edge of the set with at least two hook ended projections intended to overlie the top sheet. When the projections are driven in unison, as by a common belt, the hooks prevent the beam strength of the set from lifting the trail edge of the set out of contact with the projections.

In accordance with one aspect of the present invention, a compiler tray is disclosed for accumulating a plurality of output copy sheets on a support surface to produce a document set. The compiler tray includes: a transport belt system including at least one movable belt extending along a curvilinear path defined by a pair of rotatable roll members, with the belt having a portion situated along a substantially common plane with the support surface; an output drive roll system including at least one output roll for contacting the document set as the document set is being transported via said transport belt system; and means for driving said output roll system at a predetermined speed greater than the speed at which the transport belt system is driven to actively remove the document set from said transport belt system during transport of the document set thereon to the output tray.

In accordance with yet another aspect of the present invention, an electrostatographic printing machine including a document set delivery apparatus is provided, wherein the document set delivery apparatus comprises a transport belt system including at least one movable belt extending along a curvilinear path defined by a pair of rotatable roll members, the belt having a portion situated along a substantially common plane with the support surface; an output drive roll system including at least one output roll for contacting the document set as the document set is being transported via the transport belt system; and means for driving the output roll system at a predetermined speed greater than the speed at which the transport belt system is driven to actively remove the document set from the transport belt system during transport of the document set thereon to the output tray.

Figure 2:
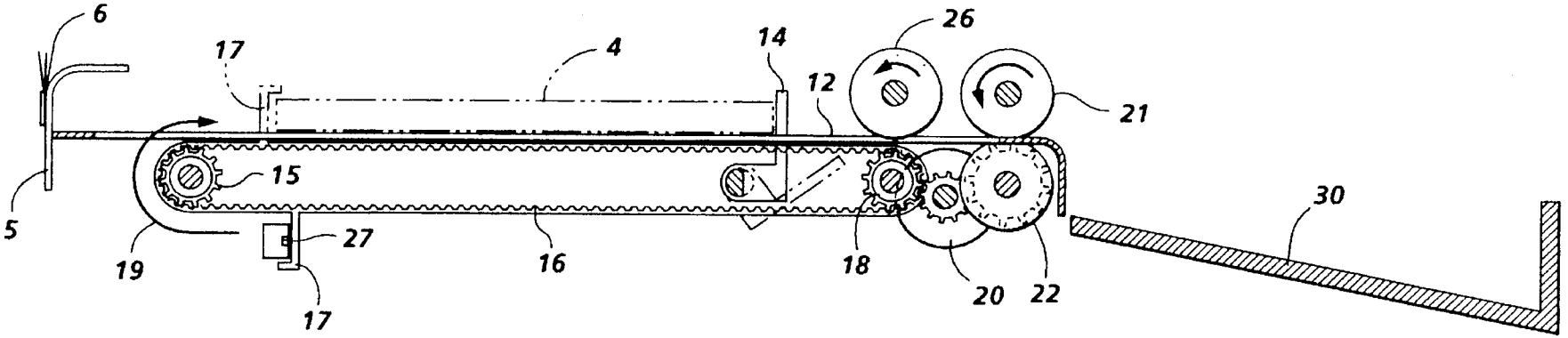

These and other aspects of the present invention will become apparent from the following description in conjunction with the accompanying drawings, in which:

FIG. 1 is a cut away perspective view of the compiler tray and document eject system of the present invention; and FIG. 2 is an elevational side view of the compiler tray and set eject system shown in FIG. 1.

While the present will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following description progresses, with specific reference to the drawings, wherein like reference numerals have been used throughout the drawings to designate identical elements therein.

Referring to FIGS. 1 and 2, there is shown a compiler tray 10 in accordance with the present invention, the compiler tray being specifically designed to be incorporated into an automatic electrostatographic printing machine for accumulating and aligning a plurality of individual copy sheets to produce a document print set 4. It is noted that, although the present invention is particularly well suited for use in an automatic electrostatographic printing apparatus, this invention is equally well adapted for use with any number of printing machines and/or other systems which require the compilation of sheets of material and the subsequent transport of such compiled materials.

As can be seen from FIG. 1, an output copy sheet 2 is delivered to the compiler tray 10 through the transport motion of the sheet 2 in the direction of arrow 3. Initially, the sheet travels over an inlet member 5 having a plurality of fibers 6 extending therefrom for contacting the underside of the sheet 2 to remove static charges which may have accumulated on the sheet 2 during transport motion thereof and for cleaning particles of dust and other contaminants from the surface thereof.

After traveling over the inlet member 5, the sheet is delivered to a rigid support surface 12 of the compiler tray 10, coming to rest on a pair of transport belts 16. Each transport belt 16 extends along a curvilinear path defined by a drive roll 18 and a journal roll 15 which are positioned such that at least one portion of each transport belt 16 is located along a plane substantially common with the rigid support surface 12, situated along an opening therein. In operation, output copy sheets 2 are directed into the tray 10 in seriatum, with the tray 10 and transport belts 16 operating as a depository for collecting and accumulating copy sheets making up a particular document set.

The copy sheets 2 accumulating in the tray 10 are positioned in abutment with a registration surface which may include a displaceable registration fence comprising at least two pivotable registration fingers 14 sufficiently spaced apart to receive A4 and similar size paper. A third finger may also be provided, as illustrated in FIG. 1, to assist in locating output copy sheets of greater dimensions. In addition, a corner registration apparatus (not shown) may be provided for urging the output copy sheets delivered to the tray to be positioned in abutment with the registration fingers 14. One exemplary embodiment of a suitable corner registration apparatus is disclosed in U.S. Pat. No. 4,541,626, wherein a wiper assembly is provided, having a plurality of blades arranged to wipe against the output copy sheets in the compiler tray for urging the sheets into corner registration. As previously noted, the registration fingers 14 are pivotably mounted for rotation about an axis, as illustrated in phantom in FIG. 2, such that the registration fingers 14 may be retracted to allow for ejection of document sets into a collection tray 30 or other suitable collection device such as a set stacker which may have an elevating mechanism for providing increased sheet capacity.

Eventually, as a plurality of copy sheets are accumulated in the compiler tray 10, a stack of sheets 4 is formed to produce an integral document set, as recognized, for example, by a comparison of the number of copy sheets delivered to the compiler tray 10 and the number of sheets in an original document set being copied. It is generally desirable to transport the document set to an output tray 30 where the stack may be stapled or otherwise bound or processed to produce a final document set. It will be understood that the document set could be stapled or otherwise sound in the compiler tray prior to transport to the output tray. In the compiler tray of the present invention, document set transport or ejection from the compiler tray 10 is effected via a document set delivery apparatus including the previously described transport belts 16 operating in conjunction with an output drive roll system including output rolls 22.

Describing the belt drive system in greater detail, each transport belt 16 is engaged with a drive roller 18 which is further coupled to a motor 20, whereby the motor 20 is selectively energized to drive the transport belts 16 in a clockwise direction as viewed in the drawing and indicated by arrow 19. In addition, each eject transport belt 16 is provided with a resilient eject finger 17 projecting substantially perpendicularly from the exposed surface of the belt 16, as can be seen in FIG. 1, for assisting in the set eject process. Thus, belt 16 is adapted to remain stationary for a selected period to accumulate a stack of output copy sheets in the compiler tray 10. At the start of a set ejection cycle, motor 20 is energized such that the eject transport belts 16 are driven along the path of travel between rolls 18, the belt being further adapted to be driven by the motor 20 for a. Correspondingly, each eject finger 17 is transported into contact with the trail edge of the document set while the eject registration fingers 14 are pivoted away from the support surface 12 of the compiler tray 10 as depicted in phantom in FIG. 2, allowing the document set 4 to be transported with the motion of belt 16 in the direction of the output tray 30.

In the case of the belt transport system described hereinabove, it is very important that, as the document set is ejected from the compiler tray 10 and delivered to the output tray 30, the eject fingers 17 must be transported to a starting, or so-called "home position", identified by reference numeral 27, in preparation for a subsequent set eject cycle. As such, after a document set is ejected from the compiler tray 10, the DC motor 20 which drives the belts 16 is maintained in an energized state in order to continue to transport the eject fingers 17 until they reach a predetermined point, namely the home position 27. The continued transport motion of the eject fingers 17 toward this home position 27 tends to cause damage to the alignment of the document set at the trail edge thereof as the eject fingers 17 may travel at such a velocity that they strike the trail edge of the document set while traveling around the circumference of the drive roll 18 and prior to the complete ejection of the document set 4 from the compiler tray. The present invention addresses this problem by providing a drive roll system for contacting the document set as it is being transported via the transport belts 16 to actively remove the document set from the transport belts. The drive roll system includes a pair of output rolls 22 situated closely adjacent to respective idler rolls 21, forming a a nip therebetween. The nip is designed to receive the document set for generating a gripping force thereagainst as the output rolls 22 are rotatably driven, thereby assisting the transport motion of the document set. In order to provide the desired removal of the document set from the transport belt 16, the output rolls are are driven at a predetermined speed greater than the speed at which the transport belts 16 are driven. In a preferred embodiment the output rolls are driven at a speed approximately 20% greater than the speed at which the transport belts are driven for actively removing the document set therefrom.

FIGS. 1 and 2 illustrate two different systems for accomplishing the differential speed drive of the transport belt 16 and the output rolls 22. In the embodiment of FIG. 1, differential speeds are accomplished very simply by driving the transport belt 16 and the output rolls 22 via separate DC drive motors 20 and 24, wherein the output velocity of motor 24 is greater than the output velocity of motor 20. In an alternative embodiment, as shown at FIG. 2, differential drive speeds are accomplished via a single motor 20 coupled to both the drive roller 18 and output rolls 22, each coupled via differential gears designed to rotate output rolls 22 at a velocity greater than the velocity of drive roll 18. Clearly, those of skill in the art will appreciate that there are numerous and various devices and methods which can be used to accomplish the differential speed drive in accordance with the present invention.

The compiler tray 10 of the present invention also includes an additional feature, namely a retard roll system, which has been shown to be effective in maintaining the registration of the document set as it is transferred from the transport belts 16 to the output rolls 22. This retard roll system includes a pair of highly compressible rotatably mounted retard roll members 26 mounted downstream from the registration fingers 14 for contacting the lead edge of the document set 4 as it is being transported via the transport belts 16 and for generating a normal force against the height of the document set as it travels thereunder. Thus, the retard rolls operate as a lead edge registration device while insuring the integrity of the document set during the transition between the transport belt 16 and the output rolls 22.

In review, the document set compiler and eject system of the present invention includes a belt transport system as well as an output roll system, wherein the belt and rolls of each respective system operate in conjunction with one another to provide smooth and effective transport of the document set from the compiler tray to an output tray. In particular, the output rolls are driven at a speed substantially greater than the speed of the transport belts for actively removing the document set from the belts to prevent damage to the trail edge thereof. The compiler tray also includes a retard roll system for maintaining the registration of the document set as it is transferred from the transport belts to the output rolls.

It is, therefore, evident that there has been provided, in accordance with the present invention, a document set compiler and eject system that fully satisfies the aspects of the invention as hereinabove set forth. While the invention has been described in conjunction with a preferred embodiment thereof, it is evident that many alternatives, modifications, and variations will be apparent to those skilled in the art. Accordingly, the present application is intended to embrace all such alternatives modifications and variations as are within the broad scope and spirit of the appended claims.

I claim:

1. A compiler tray for accumulating a plurality of output copy sheets delivered to a support surface thereof, to produce a document set, including means for transporting the document set to an output tray, comprising:

a transport belt system including at least one movable belt for being selectively driven along a curvilinear path defined by a pair of rotatable roll members, said at least one movable belt having a portion situated along a substantially common plane with the support surface, wherein said at least one movable belt is adapted to remain stationary for a selected time to accumulate a stack of output copy sheets on the support surface, said at least one movable belt being further adapted to be selectively driven for effecting transport motion of said transport belt system;

an output drive roll system including at least one output roll for contacting the document set as the document set is being transported via said transport belt system; and means for driving said output drive roll system at a predetermined speed greater than a speed at which said transport belt system is driven to actively remove the document set from said transport belt system during transport of the document set to the output tray.

2. The compiler tray of claim 5, wherein said driving means includes means for driving said at least one output roll at a speed approximately 20% greater than the speed at which the at least one movable belt is driven for actively removing the document set therefrom.

3. The compiler tray of claim 5, wherein said output drive roll system further includes at least one idler roll situated closely adjacent to said at least one output roll for forming a nip to receive the document set and to generate a gripping force against the document set as the document set is being transported via said transport belt system.

4. The compiler tray of claim 5, wherein said at least one movable belt further includes an eject finger extending from said at least one movable belt for contacting the document set along the portion situated along the substantially common plane with the support surface to contact a trail edge of the document set as the at least one movable belt travels along the curvilinear path defined by the pair of rotatable roll members.

5. The compiler tray of claim 1, further including a registration fence comprising at least two pivotable registration fingers for aligning the plurality of output copy sheets on the support surface, said pivotable registration fingers being mounted for rotation about an axis so as to allow the document set to be transported from the support surface under influence of the transport motion of said transport belt system.

6. The compiler tray of claim 1, wherein said driving means includes:

a first motor coupled to said transport belt system for driving said transport belt system at a first predetermined speed; and a second motor coupled to said output drive roll system for driving said output drive roll system at a second predetermined speed.

7. The compiler tray of claim 1, wherein said driving means includes:

a single motor coupled to both said transport belt system and said output drive roll system; and a differential gear system for coupling said single motor to both said transport belt system and said output drive roll system so as to rotate said output drive roll system at a velocity greater than the velocity of said transport belt system.

8. The compiler tray of claim 1, further including a retard roll system including at least one highly compressible rotatably mounted retard roll member for contacting a lead edge of the document set as it is being transported via the transport belt system to maintain registration of the document set during transfer from the transport belt system to the output drive roll system.

9. An electrostatographic printing machine including a document set delivery apparatus for transporting a document set to an output tray, said document set delivery apparatus, comprising:

a transport belt system including at least one movable belt for being selectively driven along a curvilinear path defined by a pair of rotatable roll members, said at least one movable belt having a portion situated along a substantially common plane with a support surface, wherein said at least one movable belt is adapted to remain stationary for a selected period to accumulate a stack of output copy sheets on the support surface, said at least one movable belt being further adapted to be selectively driven for effecting transport motion of said transport belt system;

an output drive roll system including at least one output roll for contacting the document set as the document set is being transported via said transport belt system; and means for driving said output drive roll system at a predetermined speed greater than a speed at which said transport belt system is driven to actively remove the document set from said transport belt system during transport of the document set to the output tray.

10. The electrostatographic printing machine of claim 9, wherein said driving means includes means for driving said at least one output roll at a speed approximately 20% greater than the speed at which the at least one movable belt driven for actively removing the document set therefrom.

11. The electrostatographic printing machine of claim 9, wherein said output drive roll system further includes at least one idler roll situated closely adjacent to said at least one output roll for forming a nip to receive the document set and to generate a gripping force against the document set as the document set is being transported via said transport belt system.

12. The electrostatographic printing machine of claim 9, wherein said at least one movable belt further includes an eject finger extending from said at least one movable belt for contacting the document set along the portion situated along the substantially common plane with the support surface to contact a trail edge of the document set as the at least one movable belt travels along the curvilinear path defined by the pair of rotatable roll members.

13. The electrostatographic printing machine of claim 9, further including a registration fence comprising at least two pivotable registration fingers for aligning the plurality of output copy sheets on the support surface, said pivotable registration fingers being mounted for rotation about an axis so as to allow the document set to be transported from the support surface under influence of the transport motion of said transport belt system.

14. The electrostatographic printing machine of claim 9, wherein said driving means includes:

a first motor coupled to said transport belt system for driving said transport belt system at a first predetermined speed; and a second motor coupled to said output drive roll system for driving said output drive roll system at a second predetermined speed.

15. The electrostatographic printing machine of claim 9, wherein said driving means includes:

a single motor coupled to both said transport belt system and said output drive roll system; and a differential gear system for coupling said single motor to both said transport belt system and said output drive roll system so as to rotate said output drive roll system at a velocity greater than the velocity of said transport belt system.

16. The electrostatographic printing machine of claim 9, further including a retard roll system including at least one highly compressible rotatably mounted retard roll member for contacting a lead edge of the document set as it is being transported via the transport belt system to maintain registration of the document set as it is transferred from the transport belt system to the output drive roll system.

* * * * *